US009770097B2

(12) United States Patent
Ehrreich et al.

(10) Patent No.: US 9,770,097 B2
(45) Date of Patent: Sep. 26, 2017

(54) FOLDABLE TABLE

(71) Applicant: BBY SOLUTIONS, INC., Richfield, MN (US)

(72) Inventors: Jason A. Ehrreich, Farmington, MN (US); Christopher M. Damm, Blaine, MN (US); David R. Leeder, Lakeville, MN (US)

(73) Assignee: BBY SOLUTIONS, INC., Richfield, MN (US)

( * ) Notice: Subject to any disclaimer, the term of this patent is extended or adjusted under 35 U.S.C. 154(b) by 0 days.

(21) Appl. No.: 15/049,848

(22) Filed: Feb. 22, 2016

(65) Prior Publication Data

US 2017/0238696 A1 Aug. 24, 2017

(51) Int. Cl.

| | |
|---|---|
| ***A47B 85/00*** | (2006.01) |
| ***A47B 5/04*** | (2006.01) |
| ***A47B 5/06*** | (2006.01) |
| ***A47B 3/091*** | (2006.01) |
| ***A47B 9/20*** | (2006.01) |
| ***A47B 3/087*** | (2006.01) |

(52) U.S. Cl.

CPC ..... *A47B 5/04* (2013.01); *A47B 3/087* (2013.01); *A47B 3/0912* (2013.01); *A47B 5/06* (2013.01); *A47B 9/20* (2013.01)

(58) Field of Classification Search

CPC .. A47B 5/04; A47B 5/06; A47B 3/087; A47B 3/0912; A47B 9/20

See application file for complete search history.

(56) References Cited

U.S. PATENT DOCUMENTS

| | | | | | |
|---|---|---|---|---|---|
| 480,799 | A * | 8/1892 | Wilms | A47B 83/045 | 108/33 |
| 2,112,087 | A * | 3/1938 | Golod | A47B 83/045 | 126/500 |
| 2,914,191 | A | 11/1959 | Bowden et al. | | |
| 3,080,832 | A * | 3/1963 | Schroemges | A47B 1/08 | 108/13 |
| 4,155,609 | A | 5/1979 | Skafte et al. | | |

(Continued)

OTHER PUBLICATIONS

"Adjustable-Height Folding Tables Are Portable and Can Be Adjusted to 3 Separate Heights", [online]. Displays2go. [retrieved on Jan. 18, 2016]. Retrieved from the Internet: <URL: http://www.amazon.com/Adjustable-Height-Folding-Portable-Adjusted-Separate/dp/B009AZ26EO>, (2016), 5 pgs.

*Primary Examiner* — Hanh V Tran

(74) *Attorney, Agent, or Firm* — Schwegman Lundberg & Woessner, P.A.

(57) ABSTRACT

Disclosed herein are foldable tables and methods for using the same. The foldable table can include at least one support member having a first and a second elongate support segments. The first support segment can be attachable to a platform. The second support segment can be slidably coupled to the first support segment along an elongate direction. The support member can be extendable between a contracted configuration and an extended configuration. In one example, at least one adjustable leg can be coupled to the support member and can be movable between a storage position and a support position. In one example, the foldable table includes a plurality of hingedly coupled tabletop panels. The first and second tabletop panels can be movable between a folded configuration and a deployed configuration.

21 Claims, 6 Drawing Sheets

(56) References Cited

U.S. PATENT DOCUMENTS

| | | | | | |
|---|---|---|---|---|---|
| 4,263,854 | A * | 4/1981 | Moore | A47B 83/045 | 108/37 |
| 4,803,930 | A * | 2/1989 | Crocoli | A47B 5/06 | 108/117 |
| 5,540,158 | A | 7/1996 | Ford | | |
| 5,549,054 | A | 8/1996 | Lewis | | |
| 6,161,486 | A * | 12/2000 | Boots | A47B 5/06 | 108/33 |
| 6,729,685 | B1 * | 5/2004 | Ebalobor | A47C 9/06 | 108/13 |
| 7,963,231 | B2 * | 6/2011 | Osborne | A47B 5/006 | 108/40 |
| 9,084,489 | B2 * | 7/2015 | Gosling | A47B 5/04 | |
| 9,474,362 | B2 * | 10/2016 | Woracek | A47B 83/045 | |
| 2013/0000525 | A1 * | 1/2013 | Hall | A47B 5/06 | 108/36 |
| 2014/0374551 | A1 | 12/2014 | Carter | | |

* cited by examiner

FOLDABLE TABLE

TECHNICAL FIELD

This document pertains generally, but not by way of limitation, to foldable tables, such as shelf-mounted foldable tables.

BACKGROUND

Existing folding tables, such as folding tables that are mountable to walls or vehicles include one or more legs or table portions that can be collapsed to reduce the size of the folding table for storage. For example, some existing folding tables can include a plurality of telescoping table portions. Existing folding tables can include a first table portion adjacent to a second table portion that is slidable within the first table portion. As a result, the first and second table portions can include an uneven top surface when they are extended. Additionally, a step can exist at the junction of the first and second table portions. As another example, some existing folding tables are designated to be stored in a vertical position. For instance, the folding table can be attached to a wall at one end. The foldable table can swivel into a vertical position along the wall. Vertically stored tables can occupy wall space and require sufficient clearance to swivel the table into a usable orientation. In some locations wall space is limited by the installation of shelving units or other items mounted to the wall.

BRIEF DESCRIPTION OF THE DRAWINGS

In the drawings, which are not necessarily drawn to scale, like numerals may describe similar components in different views. Like numerals having different letter suffixes may represent different instances of similar components. The drawings illustrate generally, by way of example, but not by way, of limitation, various embodiments discussed in the present document.

DETAILED DESCRIPTION

Figure 1:
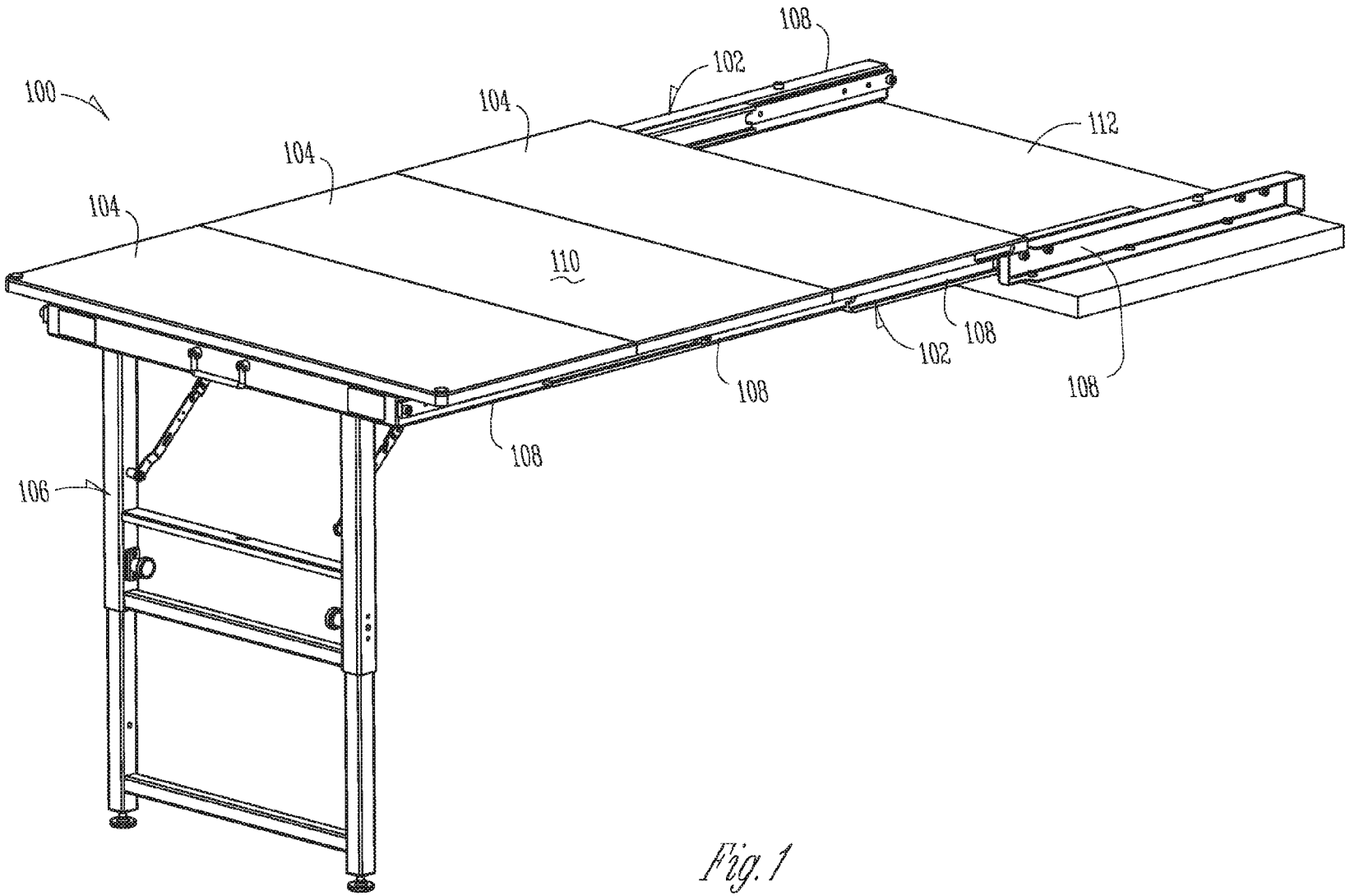
FIG. 1 illustrates a perspective view of a shelf-mountable table in a deployed configuration, according to an embodiment.

The present application relates to devices and techniques for a foldable table, such as a foldable table configured for mounting to a platform. The following detailed description and examples are illustrative of the subject matter disclosed herein; however, the subject matter disclosed is not limited to the following description and examples provided. Portions and features of some embodiments may be included in, or substituted for, those of other embodiments. Furthermore, the embodiments set forth in the claims encompass all available equivalents of those claims.

The present inventors have recognized, among other things, that a problem to be solved can include storing a foldable table on a platform (e.g., shelf) and deploying foldable tabletop panels to configure a tabletop surface that includes a deployed length that is greater than two-times a folded length, a substantially flat surface without substantial ridges or height variations, an adjustable height. The present subject matter can provide a solution to these problems, for instance, by constructing a foldable table with at least one support member coupled to a platform. The support member can include a plurality of support segments that telescope with respect to one another to extend the length of the support member. The foldable table can include a first tabletop panel coupled to the support member and one or more secondary tabletop panels hingedly coupled to the first tabletop panel. The table top panels can be arranged along the support member in a substantially flat configuration having minimal height variations among the plurality of tabletop panels. At least one adjustable leg can hingedly coupled to the support member or the tabletop panel to support the foldable table in the deployed configuration.

In an example, the telescoping support member and foldable tabletop panels can minimize the storage size of the foldable table when the foldable table is in a folded configuration. When the foldable table is in the expanded configuration, the telescoping support members and foldable tabletop panels can maximize the length of the tabletop surface. For instance, an extended length of the support member can be two-hundred percent or more of a contracted length of the support member.

The telescoping support member can include a substantially flat edge along a top side of the support member and the tabletop panels can include a substantially similar thickness to other tabletop panels. The tabletop panels can be un-foldable and arranged coextensively (e.g., end-to-end) to provide a substantially flat tabletop surface along the top of the support-members. The substantially flat tabletop surface can include a substantially uniform height along the tabletop panels.

The foldable table can include a small storage size, for instance, by rotating the adjustable leg to a storage position, folding the tabletop panels (e.g., one on top of the other), and contracting the one or more support segments. As a result, the foldable table can be arranged in a folded configuration having a compact size, such as on a shelf. The foldable table can be stored flat, or the foldable table can be hingedly attached to the platform and can be swiveled into an upright storage position.

FIG. 1 shows an example of a, foldable table 100, such as a shelf-mountable table in an expanded configuration. In one example, the foldable table 100 can be configured to couple to a platform 112 as shown in FIG. 1. For instance, the platform can include, but is not limited to a shelf, table, workbench, rack, or the like. The foldable table 100 can include at least one support member 102, a plurality, of tabletop panels 104, and at least one adjustable leg 106 coupled to the support member 102. The support member 102 can be extendable between a contracted configuration and an extended configuration. For instance, the support member 102 can include a plurality of support segments 108. In the example of FIG. 1, the support member 102 includes four support segments 108. The support segments 108 can be slidably coupled to one another along an elongate direction. As shown in FIG. 1, the foldable table 100 includes two support members 102 extended along a substantially horizontal orientation. The adjustable leg 106 can be coupled to at least one support member 102 to support one or more ends of the foldable table 100. In one example, the adjustable leg 106 can be rotatably coupled to the support member 102. The adjustable leg 106 can be moved between a storage position and a support position. For instance, the adjustable leg 106 can be rotated from the storage position to the support position or the other way around. A length of the adjustable leg 106 can be extended or retracted to adjust the height of the foldable table 100 at one or more ends of the foldable table 100.

In a deployed configuration, the plurality of tabletop panels 104 can be located along the support member 102 to form a tabletop surface 110 as shown in the example of FIG. 1. The one or more tabletop panels 104 can include a substantially planar shape extended along a length and width dimension and having a thickness between a first and second primary surfaces. In one example, the tabletop panel 104 can include a substantially uniform thickness. The tabletop panel 104 can be constructed from a durable material including, but not limited to, steel, aluminum, polypropylene, nylon, high-density polyethylene, polycarbonate, Acrylonitrile Butadiene Styrene (ABS), or the like.

The tabletop panels 104 can be aligned coextensively along the one or more support members 102. For instance, the tabletop panels 104 can be aligned end-to-end along the length of the tabletop panels 104. When the tabletop panels 104 are in the deployed configuration, the tabletop panels can be arranged to construct a substantially flat tabletop surface 110. For instance, the tabletop surface can be horizontal or less than five-degrees from horizontal, and the tabletop surface 110 can include a flatness of less than one-quarter inch between tabletop panels 104. Stated another way, adjacent edges (e.g., a first panel edge and a second panel edge) of two adjacent tabletop panels 104 (e.g., a first tabletop panel and a second tabletop panel) can include a height differential of less than one-quarter inch. In one example of the tabletop surface 110, the ends of adjacent tabletop panels 104 can be substantially flush in the deployed configuration to minimize a gap between the adjacently located tabletop panels 104. For instance, the adjacent ends of the tabletop panels 104 can be in contact with one another. The substantially flat surface can improve the usefulness of the table for shipping preparation or other tasks by providing a smooth surface for sliding items such as boxes along the tabletop panels. The items can rest on the tabletop surface in a flat and stable position to minimize the likelihood of items falling from the tabletop surface 110.

Figure 2:
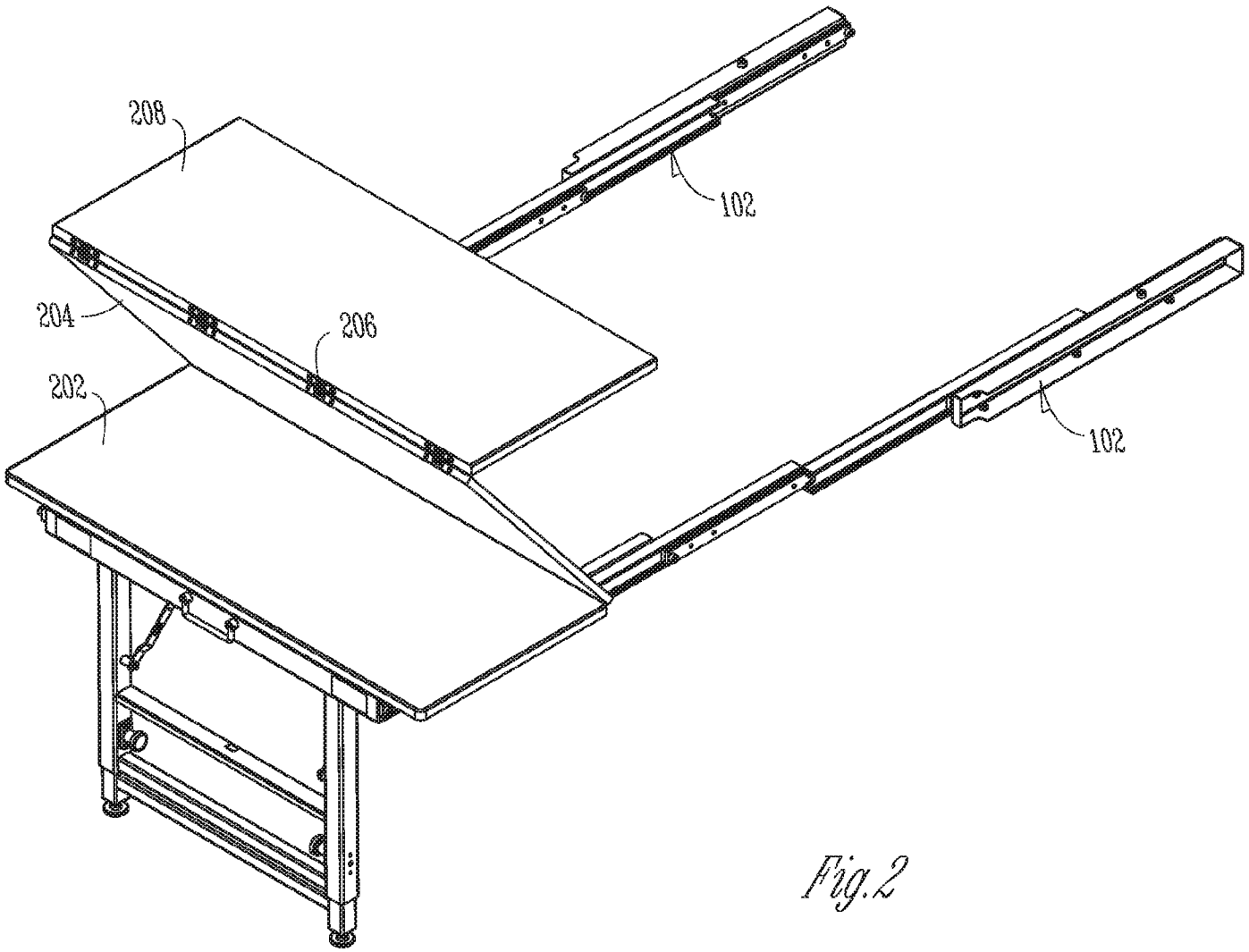
FIG. 2 illustrates a perspective view of a shelf-mountable table having a plurality of tabletop panels located between a folded configuration and a deployed configuration, according to an embodiment.
Figure 3:
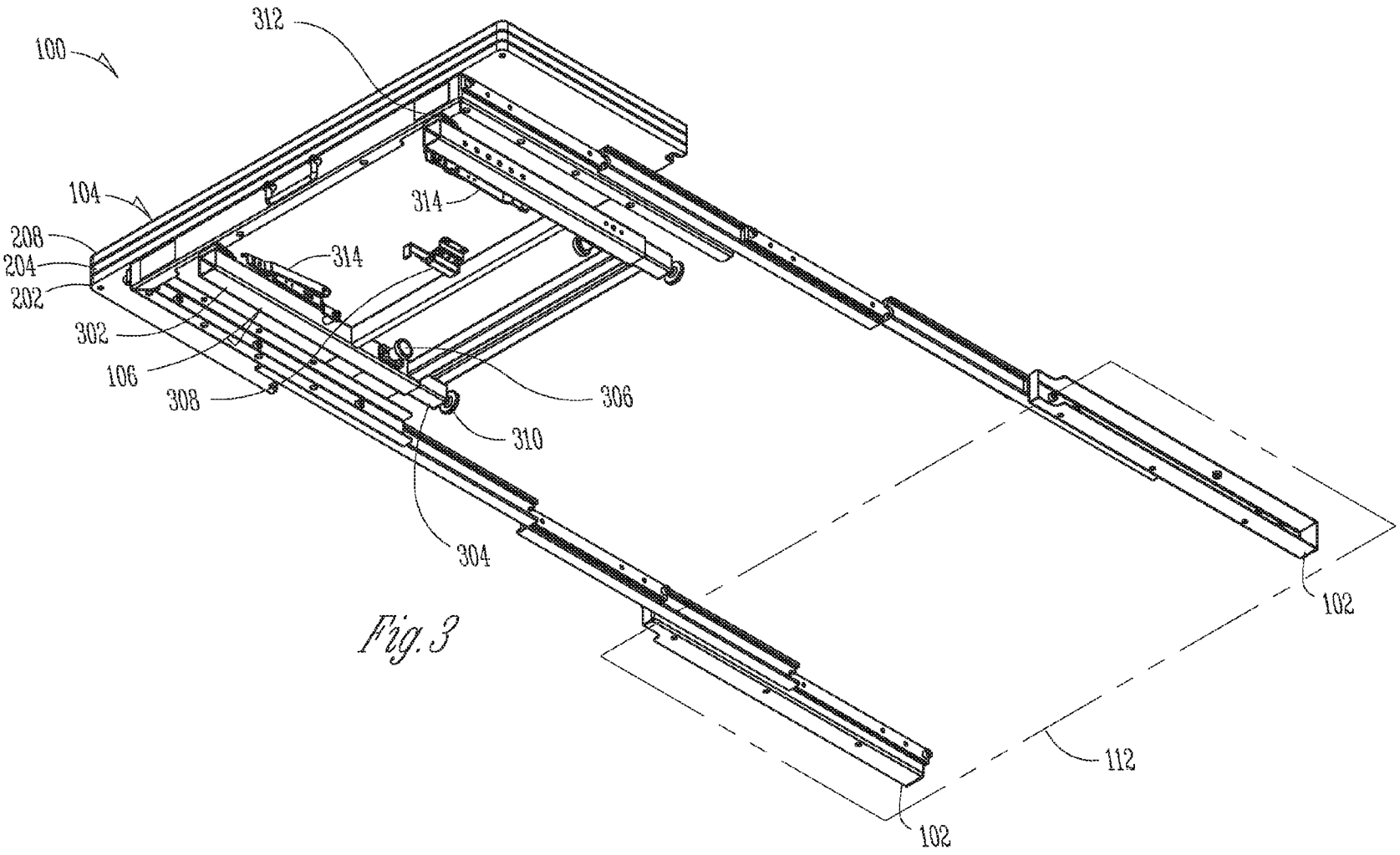
FIG. 3 illustrates a perspective view of a shelf-mountable table in a partially deployed configuration having adjustable legs in a storage position, according to an embodiment.
Figure 5:
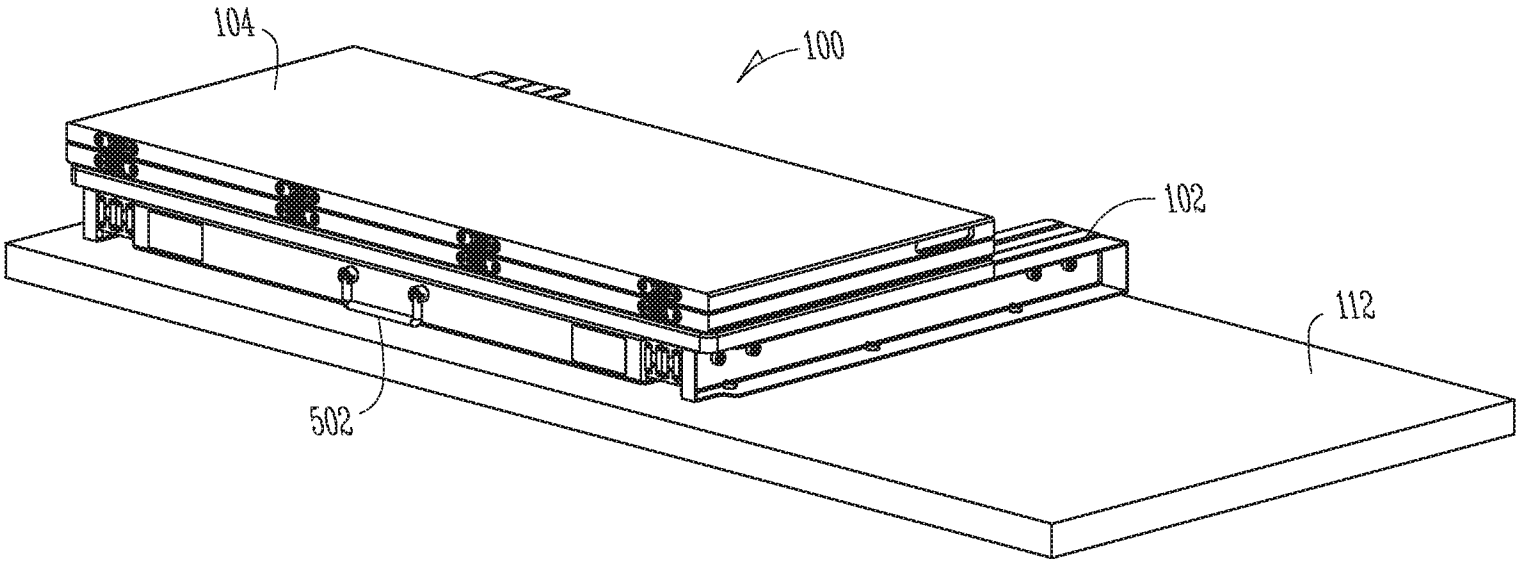
FIG. 5 illustrates a perspective view of a shelf-mountable table in a folded configuration, according to an embodiment.

FIG. 2 shows an example of a foldable table 100 including a plurality of tabletop panels 104 positioned in a partially deployed configuration. For instance, the panels are positioned between a folded configuration (as shown in FIGS. 3 and 5) and the deployed configuration (as previously shown in FIG. 1). FIG. 2 illustrates an example of the foldable table 100 including three tabletop panels 104. The tabletop panels can be hingedly attached. For instance, a first tabletop panel 202 can be coupled to a second tabletop panel 204 with a hinge 206. The hinge 206 can include, but is not limited to, a concealed hinge, gate hinge, pivot hinge, or the like.

In one example, at least one of the tabletop panels 104 can be coupled to the support member 102. For instance, the first tabletop panel 202 can be fastened to the support member 102. The fasteners can include, but are not limited to, screws, bolts, rivets, snaps, clips, magnets, or the like. The second tabletop panel 204 can be rotatable with respect to the first tabletop panel 202. For instance, an end of the second tabletop panel 204 that is remote from the first tabletop panel 202 can be rotated upwardly from the support member 102 and the second tabletop panel 204 can be rotated from the deployed configuration to the folded configuration. In the folded configuration, the second tabletop panel 204 can be moved (e.g., rotated) to a position that is superjacent to the first tabletop panel 202. For instance, the second tabletop panel 204 can be located on top of or on the first tabletop panel 202.

Where the foldable table includes a third tabletop panel 208 or greater number of tabletop panels 104, one or more tabletop panels 104 can be hingedly attached to an adjacent tabletop panel 104. For instance, the first tabletop panel 202 is hingedly attached to the second tabletop panel 204. The second tabletop panel 204 is hingedly attached to the first tabletop panel 202 and the third tabletop panel 208, and so on. The third tabletop panel 208 can be rotatable in an opposing direction to the second tabletop panel 204. Where the second tabletop panel 204 is in the folded configuration, the third tabletop panel 208 can be rotated to a position that is superjacent to the second tabletop panel 204 and the first tabletop panel 202. The tabletop panels 104 can be folded one at a time or simultaneously. The folding of the tabletop panels 104 between the deployed configuration and the folded configuration need not occur in any particular sequence.

FIG. 3 depicts an example of the foldable table 100, from a bottom perspective view, including two adjustable legs 106 in the storage position. As previously described, the foldable table 100 can include at least one adjustable leg 106. The adjustable leg 106 can be coupled to the tabletop panel 104, the support member 102, or another component of the foldable table 100. In the example of FIG. 3, the adjustable leg 106 is coupled to the first tabletop panel 202. In one example, the adjustable leg can be coupled to the support member 102. For instance, the adjustable leg 106 can be coupled to a portion of the support member 102 that is remote from a portion configured to attach to the platform 112 (e.g., shelf). The adjustable leg 106 can be rotatably coupled between the support position (as shown in FIGS. 1 and 2) and the storage position (as shown in FIG. 3 and described herein). For instance, a hinge 312 can couple the adjustable leg 106 to the foldable table 100. In one example, the adjustable leg 106 can be removably coupled to the foldable table 100 in order to move the adjustable leg 106 from the support position to the storage position. The adjustable leg can be constructed from a variety of materials including, but not limited to, aluminum, steel, polymer, or the like. The shape of the adjustable leg 106 can include a tube having a square, rectangular, circular, or other cross section.

In one example, the adjustable leg 106 can include an upper leg section 302 and a lower leg section 304 as shown in FIG. 3. The upper leg section 302 can be coupled to the support member 102. The lower leg section 304 can be slidable within a lumen of the upper leg section 302. The relative position of the lower leg section 304 can be secured with respect to the upper leg section 302 by a locking feature 306. For instance, the locking feature 306 can include, but is not limited to, a thumbscrew, a spring loaded pin, clamp, or other feature. In one example, the locking feature 306 can engage with (e.g., be positioned within) one of a plurality of apertures located along a length of the lower leg section 304 or the upper leg section 302. In other examples, the locking feature 306 can secure the upper leg section 302 to the lower leg section 304 by friction or other mechanical force. In one example, a retaining pin can be located within one or more of the plurality of aligned apertures along the length of the upper leg section 302 and lower leg section 304 in order to secure the position of the lower leg section 304 with respect to the upper leg section 302. The retaining pin can be spring loaded. For instance, the retaining pin can be attached to the lower leg section 304. A detent portion of the pin (e.g., portion that engages with the apertures of the upper leg section 302) can be retractable. For instance, a user can push or pull the locking feature 306 and correspondingly the detent portion of the pin out of engagement with the aperture. Accordingly, the lower leg section 304 can be movable relative to the upper leg section 302. When the locking feature 306 is released by the user, the spring loaded retaining pin can be biased (by a spring or the like) into the one or more apertures of the upper leg section 302, thereby securing the relative position of the lower leg section 304 with respect to the upper leg section 302.

In the support position, the adjustable leg 106 can be downwardly disposed from the support member 102. One or more folding leg supports 314 can brace the adjustable leg 106 in the support position. A length of the adjustable leg 106 can be increased by sliding the lower leg section 304 within the upper leg section 302 in a direction away from the support member 102. The locking feature 306 can secure the position of the lower leg section 304 within the upper leg section 302. Accordingly, the adjustable leg 106 can support at least a portion of the weight of the foldable table 100. In one example, the adjustable leg 106 (e.g. the lower leg section 304) can include a leveler 310. The leveler 310 can be attached to the bottom of the lower leg section 302 and can include an articulated foot with a micro-height adjustment feature. Accordingly, the leveler 310 can improve the stability of the foldable table 100 by reducing weight imbalance among the two or more adjustable legs 106.

In the storage position, the adjustable leg 106 can be aligned substantially parallel with the support member 102. The lower leg section 304 can be slidably retracted within the lumen of the upper leg section 302. Accordingly, the length of the adjustable leg can be minimized. A leg safety feature 308 can hold the adjustable leg 106 in the storage position. For instance, the leg safety feature can include, but is not limited to, a latch, magnet, fastener, strap, or the like. In one example, the leg safety feature can include a slam latch. For instance, the slam latch engages the adjustable leg 106 when the adjustable leg is moved into the storage position. To disengage (e.g., release) the slam latch, the user can actuate a release interface, such as a tab, knob, or the like. The leg safety feature 308 can couple the adjustable leg 106 to the support member 102 or tabletop panel 104 to hold the adjustable leg 106 in the storage position. Accordingly, the leg safety feature 308 can facilitate the folding and storage of the foldable table 100 by holding the adjustable leg 106 out of the way while the support members 102 are moved between the extended configuration and the contracted configuration. In one example, the leg safety feature 308 can minimize the risk of collision between the adjustable leg 106 and a user of the foldable table 100. For instance, where the adjustable leg 106 is not held by the leg safety feature 308, the adjustable leg 106 could swing from the storage configuration to the support configuration under the force of gravity. If a user's legs were in the rotational path of the adjustable leg 106, the collision could result in injury to the user or dissatisfaction with the foldable table 100. The leg safety feature 308 can be released by the user in order to rotate the adjustable leg 106 to the support position.

The plurality of tabletop panels 104 are depicted in the folded configuration in the example of FIG. 3. For instance, the second tabletop panel 204 is superjacent to the first tabletop panel 202 and the third tabletop panel 208 is superjacent to both the first tabletop panel 202 and the second tabletop panel 204. The tabletop panels 104 can be positioned flatly (parallel) on top of or below another tabletop panel 104. Accordingly, the length of the tabletop surface 110 can be reduced in preparation for storage. In one example, the length of the tabletop surface 110 in the folded configuration can be less than or equal to the length of the support member 102 in the contracted configuration.

Figure 4:
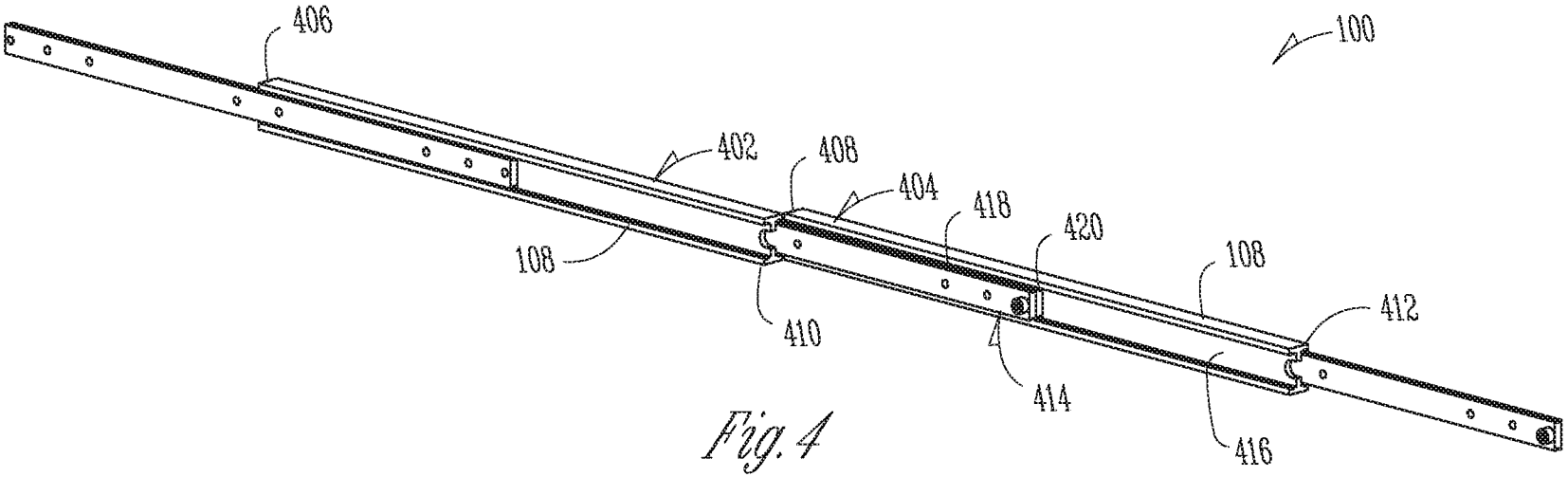
FIG. 4 illustrates a perspective view of an example of a support member including a plurality of support segments, according to an embodiment.

FIG. 4 shows an exemplary support member 102 including a plurality of support segments 108. As previously stated, the support member 102 can be configured to extend the support member 102 between the contracted configuration (shown in FIG. 4 and described herein) and the extended configuration (as shown in FIG. 1). For instance, one support segment 108 can be slidably coupled to one or more other support segments 108. Accordingly, a length of the support member 102 can be increased and decreased between a contracted length and an extended length. The support member 102 can include two, three, five, ten, or other number of support segments 108. The extended length of the support member 102 can be correspondingly increased by increasing the number of support segments 108 included in the support member 102.

The support segment 108 can include a substantially elongate shape. For instance, the support segment 108 can include, but is not limited to, a tube, beam, or a rail that is extended from a first end to a second end. The support member 102 and support segments 108 can be constructed from aluminum, steel, polymer, or the like. The support segments 108 can be slidably coupled to one another. For instance, the support member 102 can include a first support segment 402 and a second support segment 404. The second support segment 404 can be slidably coupled to the first support segment 402. The first support segment 402 and the second support segments 404 can be slidably coupled along an elongate direction of the first support segment 402 and second support segment 404. For instance, the first support segment 402 and second support segment 404 can include first ends 406, 408 and second ends 410, 412 respectively. In the contracted configuration, the first end 406 of the first support segment 402 can be located substantially adjacent to the first end 408 of the second support segment 404 and the second end 410 of the first support segment 404 can be substantially adjacent to the second end 412 of the second support segment 404. Where the support member 102 is in the extended configuration, the first end 408 of the second support segment 404 can be moved toward the second end 410 of the first support segment 402. As shown in the example of FIG. 1, the support member 102 can be extendable to a length that is greater than two-hundred percent of a length of the support segment 108. In other words, the length of the support member 102 in the extended configuration can be greater than twice the length of the support member 102 in the contracted configuration. For instance, the foldable table 100 can include a small storage size, yet have a tabletop surface that is more than twice the size of the folded configuration.

In the example of FIG. 4, a slider 414 can be located between the first support segment 402 and the second support segment 404. The support segment 108 can include a channel 416 along one or more sides of the support segment 108. For instance, the channel 416 can extend along the elongate direction of the support segment 108. In one example, the channel 416 of the first support segment 402 can be facing the channel 416 of the adjacently located second support segment 404. As shown in FIG. 4, the support segment 108 can include the channel 416 along both sides. The slider 414 can be sized and shaped to fit within the channel 416 of the first support segment 402 and the second support segment 404. A first groove 418 can be located along a top and bottom surface of the slider 414. At least one ball bearing can be located between the slider 414 and the one or more support segments 108. For instance, one or more ball bearings can be located in the first groove 418 between the slider 414 and the channel 416 of the first support segment 402. One or more ball bearings can be located in the second groove 420 between the slider 414 and the channel 416 of the second support segment 404. Accordingly, the first support segment 402 and second support segment 404 can roll along the slider 414. In other words, the support segments 108 (e.g., first support segment 402 and second support segment 404) can be slidably coupled to one another.

In one example, the first support segment 402 and the second support segment 404 can be slidably coupled by a track bearing. The track bearing can include a roller that is rotatable about a bearing shaft. For instance, the bearing shaft can be coupled to the first support segment 402. The second support segment 404 can include the channel 416 along the elongate direction of the second support segment 404. The roller can be movably coupled within the channel and translatable along the channel 416 of the support segment 108. Accordingly, the first support segment 402 and the second support segment 404 can be slidably coupled to one another. In one example, the support segments 108 can be telescopically coupled. For instance, the second support segment 404 can telescope within a lumen or a channel 416 of the first support segment 402.

As shown in FIG. 1, at least one of the support segments 108 (e.g., the first support segment 402) can be configured to couple to a platform 112. The platform 112 can include, but is not limited to, a shelf, workbench, rack, table, or the like. The first support segment 402, for example, can include mounts for coupling the support segment 108 to the platform 112. The mounts can include, but are not limited to, apertures, brackets, clamps, latches, clips, or the like. A fastener can couple the mounts of the support segment 108 to the platform 112. The support member 102 can be extended from the platform 112 along the elongate direction of the support segments 108. For instance, the second support segment 404 can be extended form the first support segment 402 in a direction away from the platform 112.

FIG. 5 shows an example of the foldable table 100 in the folded configuration. As previously mentioned, the tabletop panels 104 can be movable between the deployed configuration and the folded configuration. The support members 102 can be movable between the extended configuration and the contracted configuration. And, the one or more adjustable legs 106 can be rotatable between the support position and the storage position. Where the foldable table 100 is in the folded configuration, the tabletop panels 104 are moved to the folded configuration, the one or more adjustable legs 106 are moved to the storage position, and the support members 102 are slid to the contracted configuration. Accordingly, the foldable table 100 can be folded into a size and shape that is significantly smaller than the extended configuration of the foldable table 100. For instance, the foldable table 100 can include a length that is less than fifty-percent, thirty percent, or twenty percent of the length of the extended configuration of the foldable table 100. In one example, the foldable table 100 can be stored on the platform 112. For instance, the foldable table 100 can fit within or substantially within a volume defined in length and width by a footprint area of the platform 112. In the example of FIG. 5, the foldable table 100 can include a low profile in the folded configuration. For instance, the foldable table 100 can fit between vertically spaced shelves. In one example, a height of the foldable table 100 in the folded configuration can be less than six-inches.

In the folded configuration, the tabletop panels 104 can provide a substantially flat upper surface (e.g., substantially horizontal or substantially parallel with the platform 112) that can function as a tabletop when the foldable table 100 is in the folded configuration. Accordingly, some of the shelf space on the platform 112 can be recovered by the flat orientation of the folded tabletop panels 104. In one example, the foldable table 100 can be hingedly coupled to the platform 112. For instance, the foldable table 100 can be rotated from a platform orientation (e.g., substantially horizontal or parallel with the platform 112) to an upright orientation (e.g., substantially vertical or within twenty-degrees of vertical). For instance, the first end 406 of the first support segment 402 can be hingedly attached to the platform 112. In one example, one of the tabletop panels 104 can be hingedly coupled to the one or more support members 102. Accordingly, the tabletop panels 104 can be rotated from the platform orientation to the upright orientation with respect to the support member 102 and the platform 112.

A handle 502 can be coupled to the second end (e.g., second end 410, 412) of the support member 102. The handle 502 can be used as an interface for manually extending and contracting the support members 102 by a user. Optionally, one or more slide stops can prevent the support members 102 from sliding (e.g., extending or contracting). For instance, the slide stop can include a set screw or other mechanical fastener for inhibiting relative movement between support segments 108 of the support member 102. In one example, a motor can be operatively coupled to the one or more support members 102 to move the support member 102 between the contracted configuration and the extended configuration. For instance, the motor can be operatively coupled to the one or more support members 102 with one or more mechanical devices, including but not limited to, a rack and pinion, cable, pulley, spool or the like.

Figure 6:
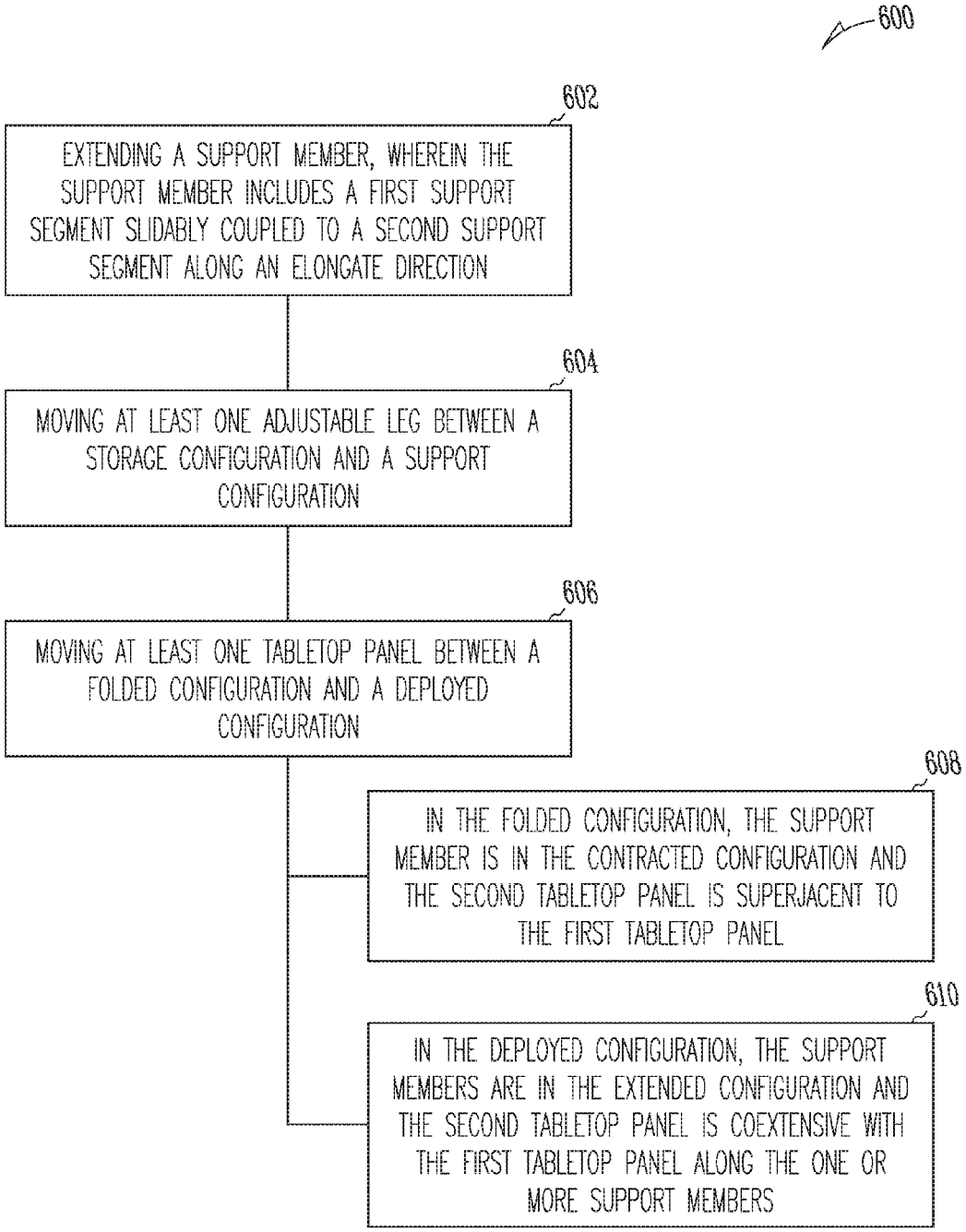
FIG. 6 is a block diagram on an exemplary method of using a shelf-mountable table, according to an embodiment.

FIG. 6 illustrates one example of a method 600 for using a foldable table 100, such as a shelf-mountable table as previously described in the examples herein and shown for instance in FIGS. 1-5. In describing the method 600, reference is made to one or more components, features, functions, and steps previously described herein. Where convenient, reference is made to the components, features, steps and the like with reference numerals. Reference numerals provided are exemplary and are nonexclusive. For instance, features, components, functions, steps, and the like described in the method 600 include, but are not limited to, the corresponding numbered elements provided herein. Other corresponding features described herein (both numbered and unnumbered) as well as their equivalents are also considered.

At 602, support member 102 can be extended. The support member 102 can include the first support segment 402 slidably coupled to the second support segment 404 along the elongate direction of the first support segment 402 and the second support segment 404. The support member 102 can be extendable between the contracted configuration the extended configuration. The length of the support member 102 can be greater than two-hundred percent of the length of the first support segment 402. In one example, the first support segment 402 can be coupled 10 to the platform 112. In one example, the method 600 can include operating a motor coupled to one of the support segments (e.g., the second support segment). The motor can be operably coupled and/or configured to move the support member 102 between the contracted configuration and the extended configuration.

At 604. At least one adjustable leg 106 can be moved between the storage configuration and the support configuration. In the support configuration, the adjustable leg 106 can support the support member 102. Optionally, the method 600 can include releasing the leg safety feature 308 configured to restrain the movement of the adjustable leg from the storage position to the support position. Accordingly, the adjustable leg 106 can be moved between the storage configuration and the support configuration.

At 606, at least one tabletop panel 104 can be moved between the folded configuration and the deployed configuration. At 608, the tabletop panel 104 can be in the folded configuration. In the folded configuration, the support member 102 can be in the contracted configuration and the second tabletop panel 204 can be superjacent to the first tabletop panel 202. At 610, the tabletop panel 104 can be in the deployed configuration. In the deployed configuration, the support member 102 can be in the extended configuration and the second tabletop panel 204 can be coextensive with the first tabletop panel 202 along the one or more support members 102. The first tabletop panel 202 can be aligned substantially flat with the second tabletop panel 204 as previously described herein. A first panel edge of the first tabletop panel 202 can be substantially flush with a second panel edge of the second tabletop panel 204 as previously discussed herein.

In one Example, the foldable table 100 can be rotated between the platform orientation and the upright orientation. In the platform orientation, the support member 102 can be in the contracted configuration and the first tabletop panel 202 and the second tabletop panel 204 can be in the folded configuration. In the upright orientation, the foldable table 100 in the platform orientation can be rotated to an orientation that is substantially lateral to the platform orientation (e.g., substantially vertical).

The above detailed description includes references to the accompanying drawings, which form a part of the detailed description. The drawings show, by way of illustration, specific embodiments in which the invention can be practiced. These embodiments are also referred to herein as "examples." Such examples can include elements in addition to those shown or described. However, the present inventors also contemplate examples in which only those elements shown or described are provided. Moreover, the present inventors also contemplate examples using any combination or permutation of those elements shown or described (or one or more aspects thereof), either with respect to a particular example (or one or more aspects thereof), or with respect to other examples (or one or more aspects thereof) shown or described herein.

The above description is intended to be illustrative, and not restrictive. For example, the above-described examples (or one or more aspects thereof) may be used in combination with each other. Other embodiments can be used, such as by one of ordinary skill in the art upon reviewing the above description.

Also, in the above Detailed Description, various features may be grouped together to streamline the disclosure. This should not be interpreted as intending that an unclaimed disclosed feature is essential to any claim. Rather, inventive subject matter may lie in less than all features of a particular disclosed embodiment. Thus, the following claims are hereby incorporated into the Detailed Description as examples or embodiments, with each claim standing on its own as a separate embodiment, and it is contemplated that such embodiments can be combined with each other in various combinations or permutations. The scope of the invention should be determined with reference to the appended claims, along with the full scope of equivalents to which such claims are entitled.

What is claimed is:

1. A foldable table comprising:

at least one support member including a first and a second elongate support segments, wherein the first support segment is attachable to an upper surface of a platform, and wherein the second support segment is slidably coupled to the first support segment along an elongate direction of the first and second support segments, and wherein the support member is extendable between a contracted configuration and an extended configuration;

at least one adjustable leg coupled to the support member, wherein the adjustable leg is movable between a storage position and a support position;

a plurality of tabletop panels including a first tabletop panel and a second tabletop panel, the first tabletop panel coupled to the support member and hingedly attached to the second tabletop panel, wherein the first and second tabletop panels are movable between a folded configuration and a deployed configuration;

in the folded configuration, the support member is in the contracted configuration and the second tabletop panel is superjacent to the first tabletop panel, wherein the support member and the plurality of tabletop panels are storable within a length and a width of the platform, wherein the first and second tabletop panels remain substantially horizontal to provide a substantially horizontal upper tabletop surface; and in the deployed configuration, the support member is in the extended configuration and the second tabletop panel is coextensive with the first tabletop panel along the at least one support member.

2. The foldable table of claim 1, wherein the first support segment is telescopically coupled to the second support segment and the support member is telescopically extendable between the contracted configuration and the extended configuration.

3. The foldable table of claim 1, wherein the first support segment is coupled to the platform.

4. The foldable table of claim 1, wherein, the first and second tabletop panels are aligned to include a substantially flat tabletop surface in the deployed configuration.

5. The foldable table of claim 1, wherein the support member is extendable to a length of greater than two-hundred percent of a length of the first support segment.

6. The foldable table of claim 1, further comprising a leg safety feature configured to restrain movement of the adjustable leg from the storage position to the support position.

7. The foldable table of claim 1, wherein a first panel edge of the first tabletop panel is substantially flush with a second panel edge of the second tabletop panel.

8. The foldable table of claim 1, wherein the second tabletop panel is hingedly attached to the first tabletop panel and a third tabletop panel, and wherein the first, second, and third tabletop panels are storable superjacent to one another.

9. A method of using a foldable table comprising:

extending a support member, wherein the support member includes a first support segment slidably coupled to a second support segment along an elongate direction of the first and second support segments, the support member is extendable between a contracted configuration and an extended configuration, wherein the first support segment is coupled to an upper surface of a platform;

moving at least one adjustable leg between a storage position and a support position, wherein the adjustable leg supports the support member in the support position;

a moving first and second tabletop panels between a folded configuration and a deployed configuration including:

in the folded configuration, the support member is in the contracted configuration and the second tabletop panel is superjacent to the first tabletop panel, wherein the support member, the first tabletop pane, and the second tabletop panel are storable within a length and a width of the platform, wherein the first and second tabletop panels remain substantially horizontal to provide a substantially horizontal upper tabletop surface; and in the deployed configuration, the support member is in the extended configuration and the second tabletop panel is coextensive with the first tabletop panel along the support member.

10. The method of using the foldable table of claim 9, further comprising aligning the first and second tabletop panels in a substantially flat arrangement.

11. The method of using the foldable table of claim 9, further comprising extending the support member to a length greater than two-hundred percent of the length of the first support segment.

12. The method of using the foldable table of claim 9, wherein moving at least one adjustable leg between the storage position and the support position includes releasing a leg safety feature, configured to restrain movement of the adjustable leg from the storage position to the support position.

13. The method of using the foldable table of claim 9, further comprising aligning a first panel edge of the first tabletop panel substantially flush with a second panel edge of the second tabletop panel.

14. The method of using the foldable table claim 9, wherein the second tabletop panel is hingedly attached to the first tabletop panel and a third tabletop panel, and wherein the first, second, and third tabletop panels are storable superjacent to one another.

15. A shelf-mountable table comprising:

a plurality of support members including a first and a second elongate support segments, the first support segment is attachable to an upper surface of a platform, the second support segment is slidably coupled to the first support segment along an elongate direction of the first and second support segments, and the plurality of support members are extendable between a contracted configuration and an extended configuration;

at least one adjustable leg rotatably coupled to at least one of said support members, the adjustable leg is movable between a storage position and a support position;

a plurality of tabletop panels including a first tabletop panel and a second tabletop panel, the first tabletop panel coupled to the plurality of support members and hingedly attached to the second tabletop panel, wherein the first and second tabletop panels are movable between a folded configuration and a deployed configuration:

in the folded configuration, the plurality of support members are in the contracted configuration and the second tabletop panel is superjacent to the first tabletop panel, wherein the support member and the plurality of tabletop panels are storable within a length and a width of the platform, wherein the first and second tabletop panels remain substantially horizontal to provide a substantially horizontal upper tabletop surface; and in the deployed configuration, the plurality of support members are in the extended configuration and the second tabletop panel is coextensive with the first tabletop panel along the at least one support member, the first and second tabletop panels configured as a tabletop surface.

16. The shelf-mountable table of claim 15, wherein the first support segment of the plurality of support members is coupled to the platform.

17. The shelf-mountable table of claim 15, wherein, the first and second tabletop panels are aligned to include a substantially flat tabletop surface in the deployed configuration.

18. The shelf-mountable table of claim 15, wherein the plurality of support members are extendable to a length of greater than two-hundred percent of a length of the first support segment.

19. The shelf-mountable table of claim 15, further comprising a leg safety feature configured to restrain movement of the adjustable leg from the storage position to the support position.

20. The shelf-mountable table of claim 15, wherein a first panel edge of the first tabletop panel is substantially flush with a second panel edge of the second tabletop panel.

21. The shelf-mountable table of claim 15, wherein the second tabletop panel is hingedly attached to the first tabletop panel and a third tabletop panel, and wherein the first, second, and third tabletop panels are storable superjacent to one another.

* * * * *